US007004183B2

(12) United States Patent
Gillis

(10) Patent No.: US 7,004,183 B2
(45) Date of Patent: Feb. 28, 2006

(54) EMERGENCY SHELTER STRUCTURE

(75) Inventor: Robert E. Gillis, 224 W. O'Connor, Menlo Park, CA (US) 94025

(73) Assignee: Robert E. Gillis, Menlo Park, CA (US)

( * ) Notice: Subject to any disclaimer, the term of this patent is extended or adjusted under 35 U.S.C. 154(b) by 41 days.

(21) Appl. No.: 09/919,748

(22) Filed: Jul. 31, 2001

(65) Prior Publication Data

US 2003/0024561 A1 Feb. 6, 2003

(51) Int. Cl.
*E04H 15/36* (2006.01)

(52) U.S. Cl. ..... 135/124; 135/136; 135/119; 135/120.4; 135/906

(58) Field of Classification Search ..... 135/123, 135/124–125, 97, 119, 120.4, 120.3, 120.1, 135/87, 136, 114, 156, 906
See application file for complete search history.

(56) References Cited

U.S. PATENT DOCUMENTS

| | | | | |
|---|---|---|---|---|
| 3,314,630 A | | 4/1967 | Lewis, Sr. | |
| 3,376,879 A | * | 4/1968 | Huddle | 135/121 |
| 3,749,107 A | | 7/1973 | Laberge | |
| 3,765,134 A | * | 10/1973 | Gilchrist | 52/63 |
| 3,843,410 A | | 10/1974 | Spahrbier et al. | |
| 3,863,659 A | | 2/1975 | Gillis | |
| 3,889,433 A | * | 6/1975 | Eubank, Jr. | 52/86 |
| 3,986,519 A | | 10/1976 | Gillis | |
| 4,099,533 A | | 7/1978 | Gillis | |
| 4,106,520 A | * | 8/1978 | Warner et al. | 135/133 |
| 4,175,305 A | | 11/1979 | Gillis | |
| 4,265,259 A | | 5/1981 | Gillis | |
| 4,265,260 A | | 5/1981 | Gillis | |
| 4,308,647 A | | 1/1982 | Gillis | |
| 4,414,993 A | | 11/1983 | Gillis | |
| 4,665,935 A | * | 5/1987 | Nichols | 135/125 |
| 4,677,999 A | * | 7/1987 | Cannon et al. | 135/97 |
| 4,706,696 A | | 11/1987 | Gillis | |
| 4,709,718 A | * | 12/1987 | Nichols | 135/115 |
| 4,809,726 A | | 3/1989 | Gillis | |
| 4,941,499 A | * | 7/1990 | Pelsue et al. | 135/125 |
| 4,944,322 A | | 7/1990 | Gillis | |

(Continued)

FOREIGN PATENT DOCUMENTS

DE 2521913 11/1976

(Continued)

OTHER PUBLICATIONS (5) Sierra Designs Catalogs depicting tents and connectors, Sierra Designs, 1255 Powell Street, Emeryville, California 94608 (1987, 1991, 1992, 1995, ).

(Continued)

*Primary Examiner*—Winnie Yip
(74) *Attorney, Agent, or Firm*—Townsend and Townsend and Crew LLP

(57) ABSTRACT

A shelter structure is disclosed having a substantially dome-shaped frame comprising a plurality of flexible resilient poles maintained under tension in substantially arcuate shape. The poles are arranged in intersecting relationship and form a plurality of pole crossings. Opposite ends of the poles terminate in a common plane such as the ground or a base. The pole arrangement creates a plurality of adjacent four-sided openings having pole crossings as vertices and sections of poles as sides. A plurality of tension harnesses interconnect diagonal vertices of adjacent openings, thereby providing strength and rigidity to the structure. The frame defines an interior volume and a membrane or covering is connected to the frame to substantially shelter the interior volume.

20 Claims, 2 Drawing Sheets

U.S. PATENT DOCUMENTS

| | | | | | |
|---|---|---|---|---|---|
| 4,998,552 | A | * | 3/1991 | Niksic et al. | 135/136 |
| 5,117,852 | A | * | 6/1992 | Bryant | 135/125 |
| 5,274,980 | A | * | 1/1994 | Zeigler | 52/646 |
| 5,388,311 | A | | 2/1995 | Solbeck | |
| 5,477,876 | A | | 12/1995 | Moss | |
| 5,628,336 | A | * | 5/1997 | Lee | 135/120.3 |
| 5,634,483 | A | * | 6/1997 | Gwin | 135/131 |
| 5,642,750 | A | | 7/1997 | Brown | |
| 5,871,026 | A | | 2/1999 | Lin | |
| 5,901,727 | A | * | 5/1999 | Kramer et al. | 135/120.1 |
| 6,145,527 | A | | 11/2000 | Gillis | |

FOREIGN PATENT DOCUMENTS

| | | | | |
|---|---|---|---|---|
| GB | 1103575 | | 5/1965 | |
| JP | 2-66271 | * | 3/1990 | 52/2.24 |

OTHER PUBLICATIONS (1) Recreational Equipment Inc. Catalog depicting tents and connectors, 1700 45th Street East, Sumner, Washington 98390 (1994).

Mountain Hard Wear Catalog, pp. 6-15 depicting tents and connectors, 950 Gilman Street, Berkeley, California 94710, publication date unknown.

(2) The North Face brochures, pp. 8-17 and pp. 30-37, The North Face, 999 Harrison Street, Berkeley, California 94710 (1994).

* cited by examiner

EMERGENCY SHELTER STRUCTURE

BACKGROUND OF THE INVENTION

This invention relates to flexible shelter structures such as tents and the like.

Numerous flexible shelter and tent structures are described in the prior art. For example, various convex multi-poled tent structures are described in U.S. Pat. Nos. 3,986,519, 4,099,533, 4,265,260, 4,414,993, and 6,145,527, all of which are owned by the inventor of the present invention. U.S. Pat. Nos. 3,986,519 and 4,099,533 both disclose dome-like structures composed of a plurality of flexible pole or rod elements maintained under tension in a generally arcuate shape, and an underlying membrane. Each structure includes at least two intersecting sets of such pole or rod elements. The rod or pole elements are held in fixed relationship at intersections by fittings secured to the underlying flexible membrane or sheath. The underlying membrane or sheath acts as a tension member to maintain the poles under tension.

U.S. Pat. Nos. 4,265,260 and 4,414,993 disclose a flexible vault structure which similarly includes a plurality of flexible resilient poles that are held under tension in generally arcuate shape by an underlying fabric member. U.S. Pat. No. 4,265,260 discloses the use of fabric sleeves in addition to fittings for coupling the poles to the underlying fabric member.

U.S. Pat. No. 6,145,527 discloses a dome style shelter structure having a plurality of tension members or a tension web associated with the poles in order to provide further tension force on the poles and further rigidity to the overall structure. Each tension member or web associated with a pole is connected to the pole at spaced locations along the pole's length. The tension members or web further tension the poles in their own planes.

The foregoing shelter structures tend to find use primarily for recreational purposes such as camping, backpacking, and the like. There remains a need for exceptionally strong, temporary shelter structures that can be manufactured at relatively low cost, that use common and easily obtained materials, that can withstand extreme and varying weather conditions over extended periods of time, and that can be made large enough to accommodate entire families if need be. For example, in times of hurricane, flood, and other environmental disasters, entire families may be displaced from their homes. Emergency relief and aid organizations often are challenged to find suitable shelter for such victims, particular shelters that can withstand extreme conditions, and that can be used over extended periods of time while permanent structures are repaired or rebuilt. The present invention addresses these needs.

BRIEF SUMMARY OF THE INVENTION

The present invention resides in a shelter structure which has a plurality of poles arranged in intersecting relationship and forming a plurality of pole crossings to form a frame. The frame has one or more four sided openings, each such opening having pole crossings as vertices and sections of said poles as sides thereof. Each of the poles has a first terminal end and a second terminal end, and each of the poles assumes a substantially arcuate shape under tension with its first and second terminal ends terminating in a common plane, such as the ground, to thereby define an interior volume. By grouping the intersecting poles in groups of three, at least one pole crossing is provided substantially at the top of the frame. One or more tension harnesses are connected between diagonal vertices of at least one four-sided opening, and preferably each four-sided opening. This results in an exceptionally rigid and strong frame. A covering is connected to at least some of the poles to substantially shelter the interior volume defined by the frame.

DETAILED DESCRIPTION OF THE INVENTION

Figure 1:
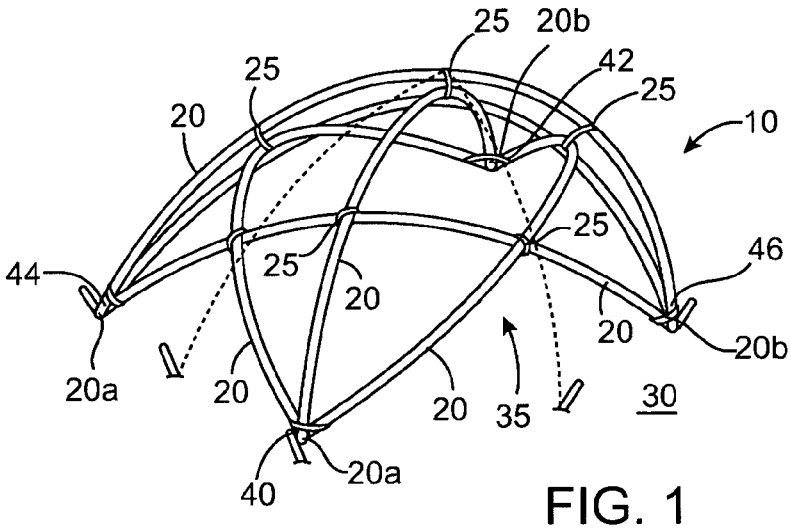
FIG. 1 is a perspective view of a preferred frame for a shelter structure embodying the present invention.

Presently preferred embodiments of the invention will now be described in detail with reference to the drawings, wherein similar parts are identified by like reference numerals.

FIG. 1 illustrates a frame for a presently preferred form of shelter structure according to the invention. The frame 10 is formed by a plurality of flexible, resilient elongated poles 20, which are arranged in an intersecting pattern and which form a plurality of pole crossings 25. The poles 20 have opposite first and second terminal ends 20*a*, 20*b*, which terminate in a common plane 30, such as the ground or a base.

Under tension, the poles 20 flex in a generally arcuate shape, thereby defining a substantially dome-shaped frame having an interior volume 35. In the particular embodiment shown in FIG. 1, the terminal ends of three poles extending in a first direction are bound together and secured to the ground at 40 and 42, and the terminal ends of three other poles crossing in a second generally orthogonal direction are bound together and secured to the common plane at 44 and 46. The poles are preferably arranged such that at least one pole crossing is provided substantially at the top of the frame. In this particular configuration, the terminal ends of the poles may be bound by conventional means such as bungee cords, cable ties, or tape. The terminal ends may be secured to the common plane by any suitable means, including tent stakes for example. In addition, it may be desirable to interconnect the poles at one or more of the pole crossing locations. This also is suitably accomplished using conventional means such as bungee cords, cable ties, or tape.

The poles themselves may be formed of any suitable flexible, resilient material. Many such materials are known to those skilled in the art. A particularly preferred material for use in larger shelters which can be used in emergency situations is PVC pipe. PVC pipe is readily available, flexible, resilient, and strong. It is also relatively inexpensive, light, and stands up well to adverse elements. It may also be used for other purposes when no longer needed for the shelter structure.

Figure 2:
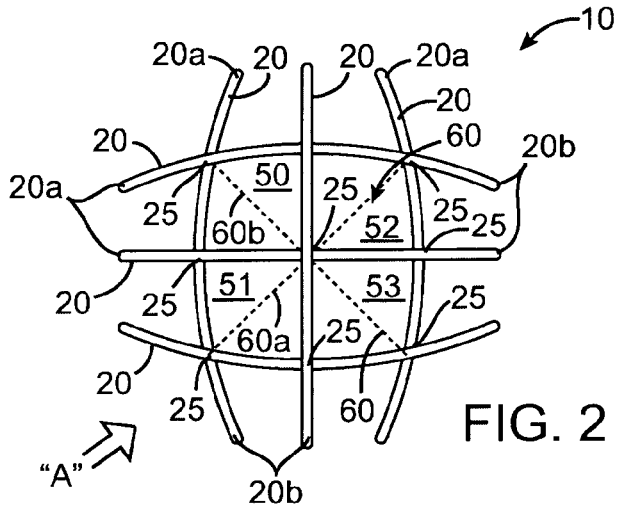
FIG. 2 is a top plan view of a portion of the frame of FIG. 1 showing one form of tension harness according to the present invention.
Figure 3:
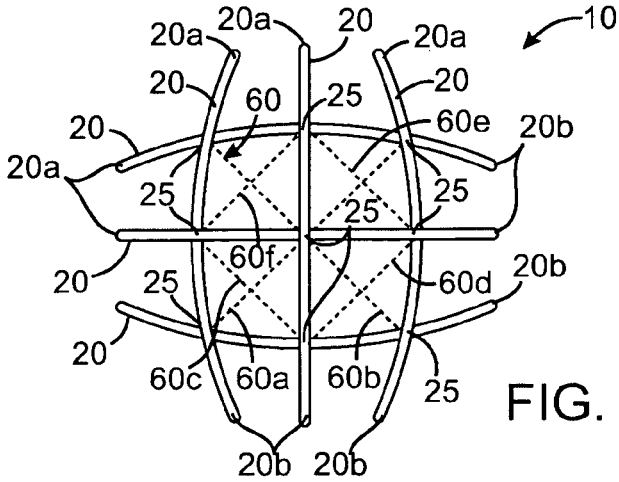
FIG. 3 is a top plan view of a portion of the frame of FIG. 1 showing another form of tension harness according to the present invention.

Referring to FIGS. 2 and 3, it is seen that the intersecting arrangement of the poles creates a number of four-sided openings in the frame, in this particular embodiment four such openings 50, 51, 52, and 53. Also, in this particular embodiment, the openings are not substantially square or rectangular but are more approximately diamond-shaped. This is due to the relative angles of the crossing poles to each other, due to binding their terminal ends together. However, in other embodiments where the terminal ends of the poles are not bound together, but where they are spaced about the common plane, the openings may approximate more perfect squares or rectangles. The invention is of course equally applicable to both configurations.

Each of the four-sided openings has four vertices corresponding to pole crossing locations. The four sides of the openings correspond to sections of the crossing poles.

A key feature of the invention is the provision of one or more tension harnesses 60, which provide exceptional strength and stability to the frame and hence the shelter structure. As shown most clearly in FIGS. 2 and 3, tension harnesses are preferably connected between the diagonal vertices of at least the openings themselves, and preferably between the diagonal vertices of adjacent openings as well. FIG. 2 illustrates a first preferred form of tension harness in which only one set of vertices of each opening and adjacent opening are interconnected. In this form, the tension harness has two portions 60*a* and 60*b*, which are approximately orthogonal to each other. FIG. 3 illustrates another preferred form of tension harness in which all of the diagonal vertices of all adjacent openings are interconnected. In this form, additional tension harness portions 60*c*, 60*d*, 60*e*, and 60*f* interconnect the remaining diagonal vertices of the adjacent openings with portions 60*c* and 60*e* being orthogonal to portion 60*a*, and portions 60*d* and 60*f* being orthogonal to portion 60*b*. In this form, the diagonal vertices of each opening are essentially interconnected by a criss-crossing tension harness.

By having a tension harness interconnect the diagonal vertices of one or more openings, forces from external sources, such as the elements are resisted by the structure, regardless of the direction of the forces. For example, without the provision of a tension harness, forces acting upon the side of the structure can cause the poles to compress and deform the shapes of the openings, and therefore the structure. Severe enough forces can cause the poles and the structure to fail. The tension harness resists external forces from all directions. For example, forces from one direction "A" will be resisted by harness portions perpendicular to "A" (60*b*), whereas forces from the orthogonal direction will be resisted by harness portions 60*a*. Forces at an angle to and not in parallel with any harness portions will be resisted by all harness portions in proportion to the angle of the force to the harness portion.

The tension harness may be constructed of individual cords or strips or an integral or interconnected set of cords or strips. Preferably the tension harness is constructed of a low stretch material such as polypropylene or high density polyethylene. The tension harness may be connected to the pole crossings by any means suitable to provide a relatively secure connection, including Grip Clips™, "S" hooks, or cord. As shown best in FIG. 1, the tension harness may extend to the common plane at one or more points and be secured there by conventional means, including tent stakes, for example.

Figure 4:
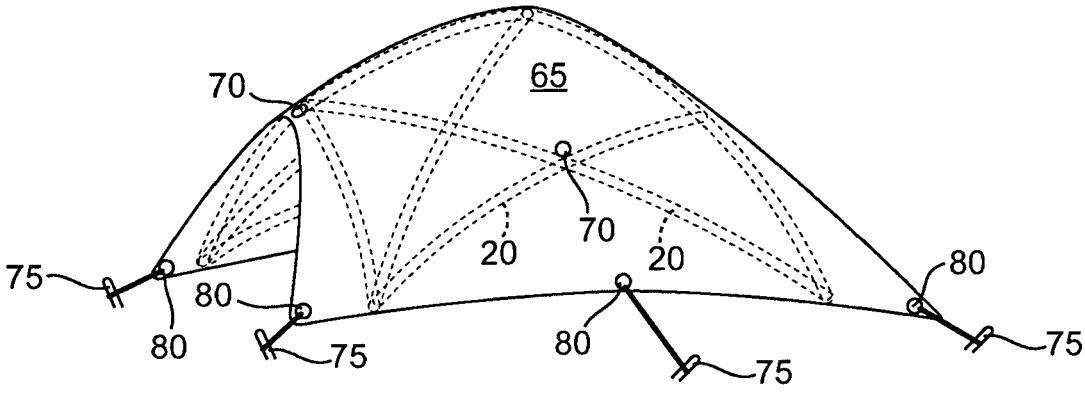
FIG. 4 is a perspective view of a preferred shelter structure according to the present invention and employing a form of tension harness integral with a covering.
Figure 5:
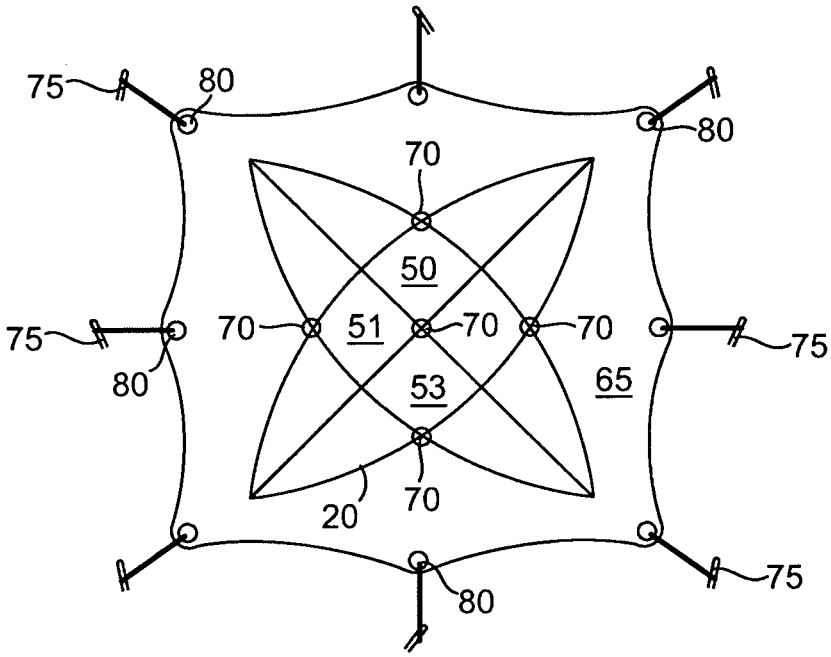
FIG. 5 is a top plan view of the shelter structure of FIG. 4.

Referring to FIGS. 4 and 5, to complete the shelter structure a membrane or covering 65 may be draped over the frame and secured to the frame and to the common plane to shelter the interior volume. The covering may be secured to the poles of the frame by any suitable means, many such means being well known to persons skilled in the art. One suitable means of attachment is commercially sold as the GripClip (TM) by Shelter Systems of Menlo Park, Calif. Others are shown and described in various patents, including some of those identified previously herein. The covering may also be secured to the common plane by any suitable means, many such means being known to persons skilled in the art, including for example, cords, rings, and tent stakes. Thus, for example, in the embodiment of FIGS. 4 and 5, the covering may be attached to the frame at multiple points 70 at or in the vicinity of pole crossing locations. The covering may be secured to the common plane using stakes 75 at multiple locations 80 around the periphery of the frame. Alternatively, if desired, the membrane or covering may be suspended from the frame rather than covering it.

The membrane or covering may be any suitable material that is relatively impervious to the elements, many such materials being known to persons skilled in the art. A particularly preferred material is laminated and woven high density polyethylene sheet. This material is strong, relatively impervious to the elements, readily available and relatively inexpensive.

As an alternative to the forms of tension harness previously described, it may be desirable to integrally form the tension harness and the covering. This can be done by employing a covering material that is itself a low stretch material, at least in the portions overlying the four-sided frame openings, and securely attaching the covering to the diagonal vertices of the four-sided openings at or in the vicinity of the pole-crossing locations. Alternatively or additionally, reinforced seams, bands, or the like may be provided in the covering to overly and extend between the diagonal vertices of the four-sided openings, with the covering being attached there as described. This arrangement creates tension lines between the vertices without requiring separate tension harness elements. Of course, both can be used simultaneously as well.

The present invention has been described herein with reference to particular presently preferred embodiments thereof. However, those skilled in the art will appreciate that a variety of modifications, changes, and substitutions may be made while retaining the features and advantages of the invention and without departing from its spirit. For example, various modifications may be made in materials, shapes and sizes of various components. Further, depending upon the desired shape, volume and usage of the flexible structure being constructed, greater or fewer poles may be used and the arrangement and configurations of the poles may be modified to construct flexible shelter structures having various shapes. Accordingly, it is intended that the invention not be limited to the particular embodiments disclosed, but that it include all embodiments and equivalents falling within the scope of the appended claims.

What is claimed is:

1. A frame for a shelter structure, comprising:

a plurality of poles arranged in intersecting relationship with a plurality of pole crossings such that at least one four sided opening is formed having pole crossings defining two non-adjacent pairs of vertices and having sections of said poles defining sides thereof, and at least one pole crossing is located substantially at the top of said frame;

each of said poles having a first terminal end and a second terminal end;

each of said poles assuming a substantially arcuate shape under tension and being arranged such that said first and second terminal ends of at least three poles terminate at a common point in a common plane to thereby define a substantially dome-shaped interior volume; and a tension harness extending substantially diagonally across said opening and. directly connecting a non-adjacent pair of vertices of said opening.

2. A shelter structure comprising the frame of claim 1 and a membrane connected to at least some of said poles to substantially shelter said interior volume.

3. The frame of claim 1 wherein said poles are arranged to form a plurality of said four-sided openings.

4. The frame of claim 1 wherein said poles are arranged such that all of the poles are arranged in groups of three with said first and second terminal ends of each pole in each group of three terminating at a common point in a common plane.

5. The frame of claim 1 wherein said tension harness directly connects each pair of non-adjacent vertices.

6. The frame of claim 3 wherein said tension harness extends substantially diagonally across and directly connects a non-adjacent pair of vertices of each of a plurality of said openings.

7. The frame of claim 3 wherein said tension harness extends substantially diagonally across and directly connects each pair of non-adjacent vertices of each of a plurality of said openings.

8. The frame of claim 1 wherein said poles are substantially flexible and resilient.

9. The frame of claim 1 wherein at least some pairs of intersecting poles are connected together near at least some of said pole crossings.

10. The frame of claim 1 wherein each pair of intersecting poles is connected together near each of the pole crossings.

11. The frame of claim 1 wherein a plurality of four-sided openings are formed, at least some of which are adjacent each other.

12. The frame of claim 11 wherein said tension hamess connects between a non-adjacent pair of vertices of at least one pair of adjacent openings.

13. The frame of claim 11 wherein said tension harness connects between a non-adjacent pair of vertices of a plurality of pairs of adjacent openings.

14. The frame of claim 11 wherein said tension hamess connects between a non-adjacent pair of vertices of all adjacent openings.

15. The frame of claim 11 having a tension harness connected between a non-adjacent pair of vertices of all diagonally adjacent openings.

16. The frame of claim 1 having a free end of said tension harness fastened to the common plane.

17. The frame of claim 1 having the free ends of said tension harness fastened to the common plane.

18. The frame of claim 1 wherein said tension harness is constructed of low stretch material.

19. The shelter structure of claim 2 wherein said tension harness is integrally formed with said membrane.

20. The shelter structure of claim 2 wherein said tension harness is connected to said membrane at a plurality of points.

* * * * *

UNITED STATES PATENT AND TRADEMARK OFFICE

CERTIFICATE OF CORRECTION

PATENT NO. : 7,004,183 B2
APPLICATION NO. : 09/919748
DATED : February 28, 2006
INVENTOR(S) : Robert E. Gillis It is certified that error appears in the above-identified patent and that said Letters Patent is hereby corrected as shown below:

At Column 6, Line 7, please delete “hamess” and insert -- harness --.

At Column 6, Line 13, please delete “hamess” and insert -- harness --.

Signed and Sealed this

Eleventh Day of July, 2006

JON W. DUDAS
*Director of the United States Patent and Trademark Office*